US008982670B1

(12) United States Patent
Pappafotis et al.

(10) Patent No.: US 8,982,670 B1
(45) Date of Patent: Mar. 17, 2015

(54) MULTI-SENSOR EVENT DETECTION SYSTEM

(75) Inventors: Jason M. Pappafotis, Panama City Beach, FL (US); Elan Moritz, Panama City Beach, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 311 days.

(21) Appl. No.: 13/560,158

(22) Filed: Jul. 27, 2012

(51) Int. Cl.
*F41H 11/136* (2011.01)
*F41H 11/16* (2011.01)
*G01S 19/01* (2010.01)

(52) U.S. Cl.
CPC ..... *F41H 11/16* (2013.01)
USPC ..... 367/124

(58) Field of Classification Search
CPC ..... G01S 11/14; G01S 3/808; F41H 11/16
USPC ..... 367/125, 124, 127; 89/1.13
See application file for complete search history.

(56) References Cited

U.S. PATENT DOCUMENTS 5,099,455 A * 3/1992 Parra ..... 367/127

OTHER PUBLICATIONS

Disposable Real-time Underwater Mine Explosion Locator (DRUMEL); 2013; Trident Research LLC; http://www.virtualacquisitionshowcase.com/browse/popup/2101.*

* cited by examiner

*Primary Examiner* — Daniel Pihulic
(74) *Attorney, Agent, or Firm* — James T. Shepherd

(57) ABSTRACT

Systems and methods to determine and ascertain the occurrence of an event are provided. The event can manifest its presence through transient signatures that alter short or long term background sensor registered signals. The system can include multiple sensors, one or more data recorders and data reporting devices. Event data from each sensor is collected, recorded and reported. Data from the various sensors is correlated to triangulate or otherwise localize the occurrence of an event. The sensors can be incorporated on a single device or can be a distributed set of independent sensors on separate devices that share their information with the data collection system.

13 Claims, 4 Drawing Sheets

MULTI-SENSOR EVENT DETECTION SYSTEM

STATEMENT OF GOVERNMENT INTEREST

The invention described herein may be manufactured and used by or for the Government of the United States of America for governmental purposes without the payment of any royalties.

BACKGROUND OF THE INVENTION (1) Field of the Invention

The present invention relates to event detection. More particularly, the present invention relates to systems and methods to determine and ascertain the occurrence of an event that manifests its presence through transient signatures that alter short term and long term background sensor registered signals.

(2) Description of the Prior Art

Currently, a number of event detection methods rely on human observation. As an illustrative example, current mine-sweeping systems are towed by a manned platform, such as a helicopter or surface ship. Since there is some level of human situational awareness, direct observation is used to recognize if the sweep system being employed has indeed swept a mine or not. Accordingly, tactical memorandums and concept of operation documents for these systems explicitly state that those manning the platform shall watch for a plume or explosion when sweeping or neutralizing mines.

The fundamental concept of mine hunting and sweeping is shifting from this perspective to an entirely unmanned operation. Larger countermeasure ships and helicopters are slated to be retired in favor of smaller unmanned systems. For mine hunting systems, detailed methods of data collection and post mission analysis (PMA) are prescribed. A human operator downloads and reviews every sonar image or other data that the system collects.

For mine sweeping, however, PMA has been neglected due to the use of manned platforms and human observations, as described previously. Current unmanned sweep systems record when the system is energized and where it is. However, there are no provisions for recording whether or not a mine firing has occurred. Further, if a mine firing has occurred, there are no provisions for recording where the mine firing occurred.

Accordingly, the judgment as to whether an area has been cleared of naval sea mines to an acceptable level has to rely on vague position and status data. Such vague data is inadequate for deciding whether to risk lives and assets in moving them through an area that may or may not be sufficiently cleared. Thus, if an unmanned sweeping capability is desired, there is a need for a multi-sensor data collection system that can detect, localize, and report mine firings that have been actuated by an unmanned sweep system.

SUMMARY OF THE INVENTION

It is therefore a general purpose and primary object of the present invention to provide systems and methods to determine and ascertain the occurrence of an event that manifests its presence through transient signatures that alter short or long term background sensor registered signals. The system can include multiple sensors, one or more data recorders and data reporting devices.

Event data from each sensor are collected, recorded and reported. Data from the various sensors is correlated to triangulate or otherwise localize the occurrence of an event. The sensors can be incorporated on a single device or can be a distributed set of independent sensors on separate devices that share their information with the data collection system.

In one embodiment, a method for detecting an event manifesting a plurality of characteristic transient signatures includes detecting one or more of the characteristic transient signatures, correlating each of the detected signatures to confirm an occurrence of the event and correlating timing and location information of the detected signatures to determine a timing and location of the occurrence. Further, the method can include displaying the occurrence and the timing and location of the occurrence.

The method can include correlating the detected signatures with historical event data to characterize the event and the method can also display the characterization of the occurrence. In detecting the signatures, the method can include deploying one or more sensors attuned to detect one or more of the characteristic transient signatures. The method can also include the sensors transmitting the detected signatures to a processor for correlation.

In deploying the sensors, the method can include conducting a sweep of an area of interest and forcing at least one occurrence of the event by said sweep. The method can also display an area where further occurrences of the event have been mitigated by the sweep. The sweep can be conducted by an unmanned mine sweeping platform, wherein the event is the detonation of a mine.

In one embodiment, a method of conducting a mine sweeping operation includes deploying an unmanned mine sweeping platform, detecting a plurality of mine explosion characteristics, correlating the detected mine explosion characteristics to confirm an occurrence of a mine explosion and determining a time and location of the mine explosion based on timing and location information associated with each of the detected mine explosion characteristics.

The method can include correlating the detected mine explosion characteristics with historical mine explosion data to characterize the mine explosion. Also, the method can include displaying the mine explosion, the timing and location of the mine explosion and the characterization of the mine explosion. Further, the method can display an area where a further occurrence of one such mine explosion event is mitigated by the mine sweeping operation.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein like reference numerals and symbols designate identical or corresponding parts throughout the several views and wherein.

DESCRIPTION OF THE INVENTION

Figure 1:
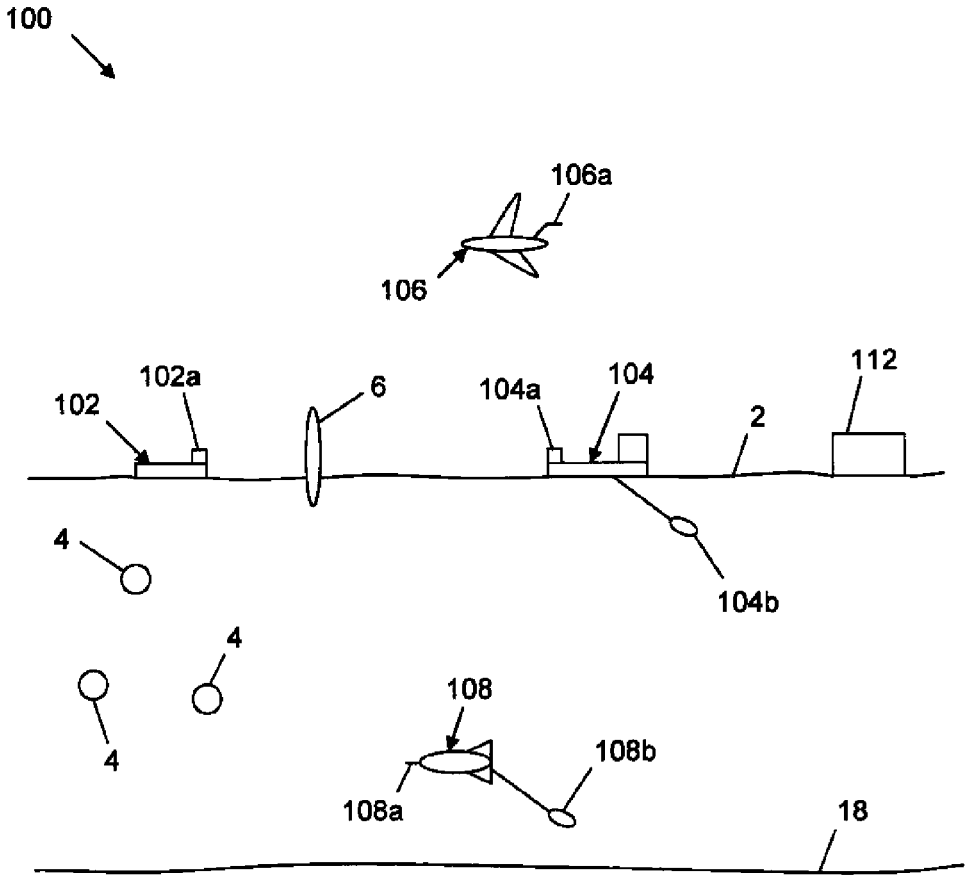
FIG. 1 illustrates a schematic elevation view of a system for detecting a mine explosion event.

For illustration and ease of description, but not for limitation, the systems and methods are described herein relative to unmanned mine sweeping operations, wherein the event occurrence to be ascertained is a mine firing or explosion event. Referring now to FIG. 1, there is shown a schematic elevation view of system 100 for detecting a mine explosion event. Unmanned platform 102 is deployed at sea surface 2 and sweeps an area of sea surface 2 in order to detect and detonate mines 4 that may be located beneath surface 2. Plume 6 illustrates the detonation of one such mine 4.

Figure 2:
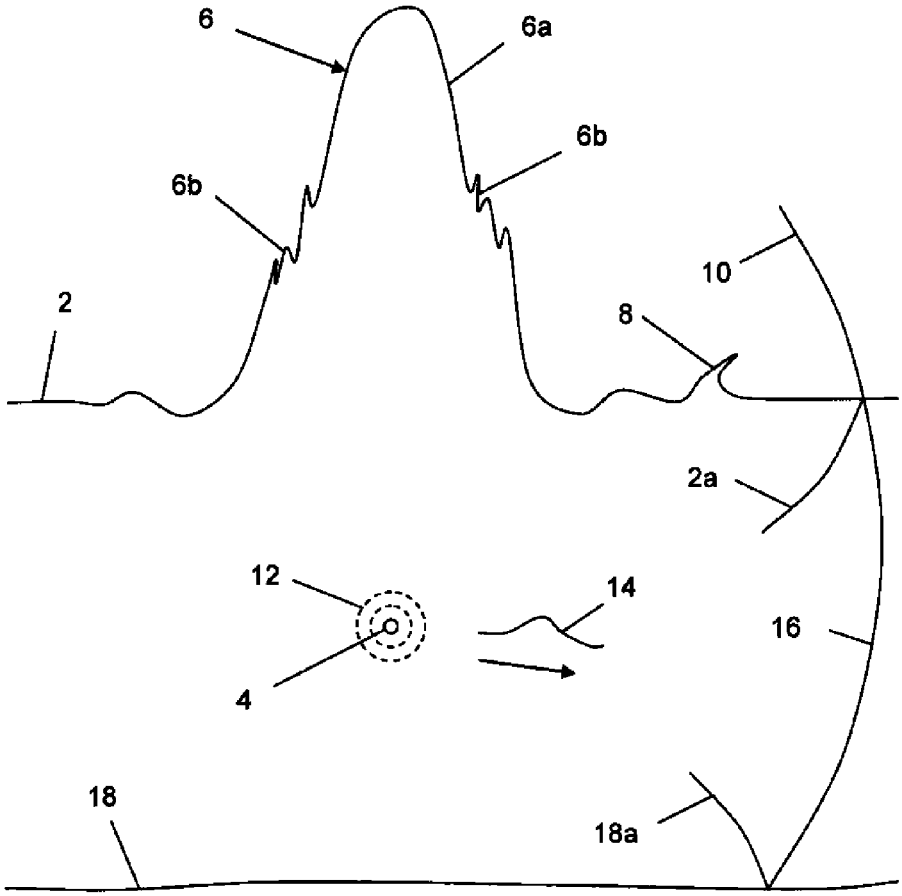
FIG. 2 (PRIOR ART)
FIG. 2 illustrates a diagrammatic view of the known effects of an underwater mine explosion event.

Referring also to FIG. 2, there is shown a diagrammatic representation of the known effects of detonating a mine 4. In addition to plume 6, which is characterized by shock spray dome 6*a* and gas bubble plumes 6*b* above sea surface 2, surface waves 8 and air blast wave 10 can be observed by sensors 102*a* aboard platform 102. Further, unmanned surface vehicle (USV) 104 and unmanned air vehicle (UAV) 106 can employ respective sensors 104*a* and 106*a* to also detect at surface and above surface effects of mine 4 detonation.

As illustrated in FIG. 2, the underwater effects of mine 4 detonation include oscillating and migrating gas bubble 12, bubble pulse 14, shock wave 16 and respective surface 2 and bottom 18 reflected shock waves 2*a* and 18*a*. Unmanned underwater vehicle (UUV) 108 can deploy sensors 108*a* to detect one or more characteristics of the underwater effects. Additionally, one or both of USV 104 and UUV 108 can deploy respective towed array sensors 104*b* and 108*b* to also detect underwater effects. Other effects can also be observed, such as possible radar signatures from parts of detonated mine 4 and temperature anomalies from the explosion.

For ease of reference, the various sensors 102*a*, 104*a*, 104*b*, 106*a*, 108*a* and 108*b* will be collectively referred to hereinafter as sensors 110. In addition to detecting explosion effects, sensors 110 include known timing and global positioning system (GPS) capabilities. The data collected by sensors 110 can be transmitted to processing platform (or processor) 112. Platform 112 correlates the data from sensors 110, and based on the detected explosion effects from sensors 110, determines if a mine explosion has occurred.

If so, processing platform 112 utilizes the timing and GPS information from sensors 110 to determine the timing and GPS location of the explosion event. Additionally, using techniques known in the art, time signal analysis of shock wave 16 and reflected shock waves 2*a* and lea can yield information regarding the depth at which mine 4 detonated.

Figure 3:
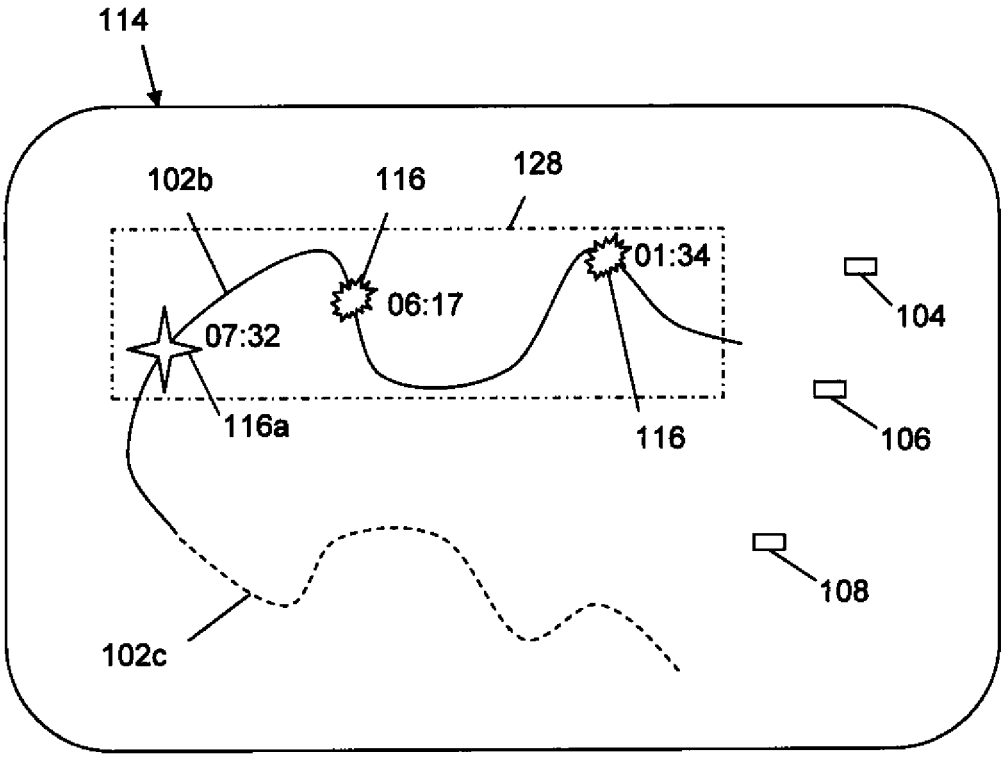
FIG. 3 illustrates a display of the system of FIG. 1.

Results from processing platform 112 can be displayed to a human operator. Referring now to FIG. 3, there is shown a schematic representation of display 114. For illustration, but not limitation, display 114 is depicted as showing the actual track 102*b* and future track 102*c* of platform 102. Actual track 102*b* is based on GPS information from platform 102.

In addition to tracking information, display 114 can depict location and timing information for detected explosion events (illustrated by symbols 116 with associated time in FIG. 3). Further information, such as the locations of sensor platforms 104, 106 and 108, may also be depicted on display 114.

Figure 4:
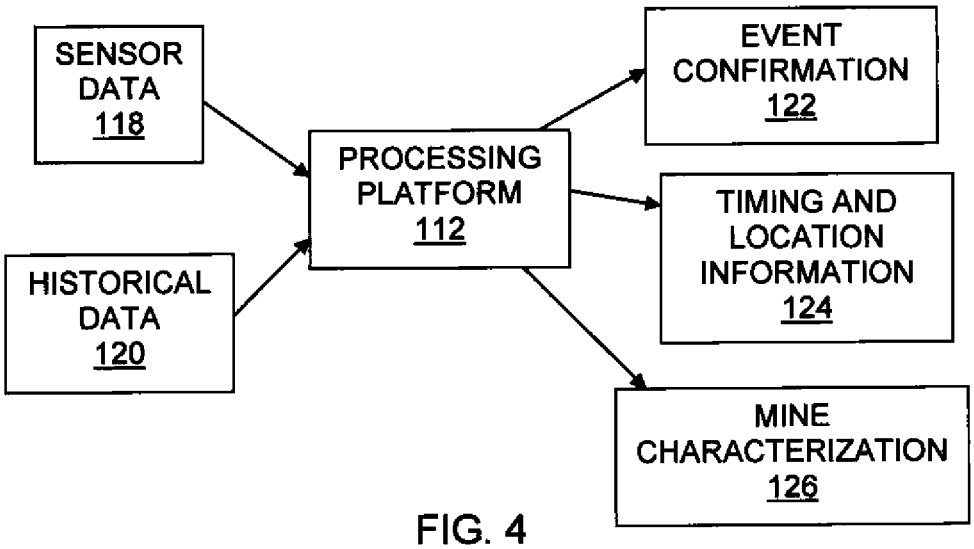
FIG. 4 illustrates an input/output diagram of the system of FIG. 1.

FIG. 4 depicts an input/output diagram for processing platform 112. In addition to data 118 from sensors 110, historical data 120 characterizing explosion effect signatures for various mines can be input to processing platform 112. With this information, a detected explosion event may be characterized as to the type and origin of the exploded mine. Thus, platform 112 outputs can include event confirmation 122, timing and location information 124 and mine characterization 126.

When characterization is possible, display 114 can include differing symbols for differing types of mines, as indicated by symbol 116*a* and associated time in FIG. 3. In addition, based on actual track 102*b* and confirmed mine explosion events (116, 116*a*), display 114 can indicate areas that have been cleared of mines to acceptable levels, as indicated by dash-dot line 128 in FIG. 3. Such information can aid in making the judgment as to whether or not to risk lives and assets in moving them through an area.

Figure 5:
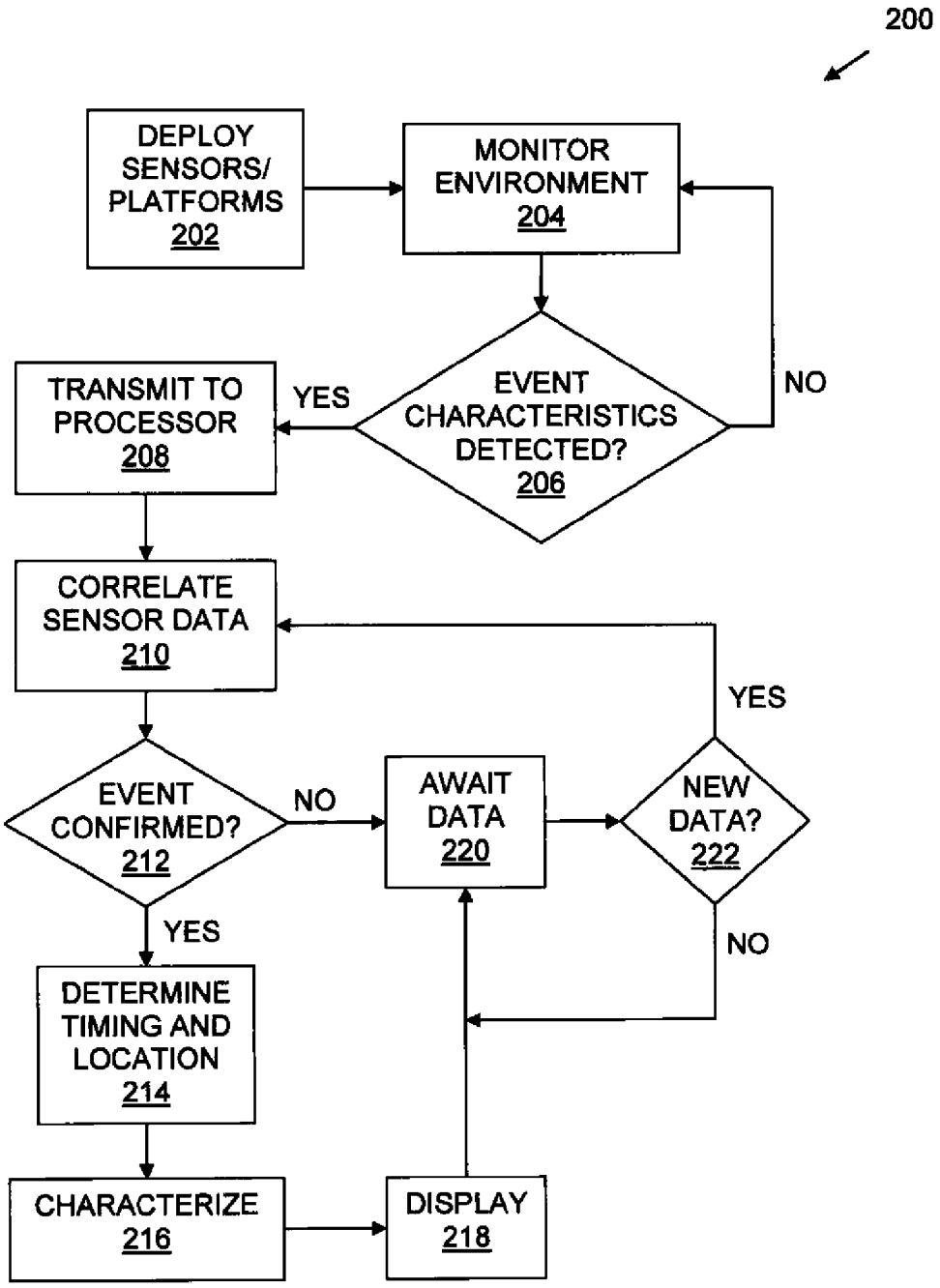
FIG. 5 is a block diagram of a method for detecting an event.

FIG. 5 depicts a block diagram of method 200 for detecting a mine explosion event. Method 200 begins by deploying sensors 110 in the environment where an event may occur (block 202), as described with respect to FIG. 1. As described previously for the case of a mine sweeping operation, sensors 110 can be located aboard suitable platforms (102, 104, 106 and 108), such that block 202 can include deploying unmanned mine sweeping platform 102, as well as USV 104, UAV 106, UUV 108 and other sensors or platforms as needed.

Sensors 110 monitor the environment (block 204) to detect one or more events, as described with respect to FIG. 2. If an event is detected, as determined at block 206, the corresponding data is transmitted (block 208) to processing platform (or processor) 112. Sensors 110 continue monitoring the environment if no characteristics are detected.

When the data is received, platform (or processor) 112 correlates the sensor data (block 210) to determine if an actual event has occurred, or the data received is an anomaly. If an event is confirmed (block 212), timing and location information is obtained (block 214) based on the GPS and timing capabilities of sensors 110.

Additionally, by comparing the sensor data to historical data, the event is characterized (block 216), as described with respect to FIG. 4. As also described with respect to FIG. 3 and FIG. 4, the event confirmation, timing and location information and characterization of the event can be displayed (block 218). Method 200 can then await new data (block 220). If new data is received, as determined at block 222, method 200 returns to block 210 to correlate the sensor data. Method 200 also awaits new data when an event is not confirmed after correlating sensor data (block 212).

What have thus been described are systems and methods to determine and ascertain the occurrence of an underwater mine explosion. The system can include multiple manned or unmanned platforms, sensors deployed on one or more of the platforms and a processing platform. Event data from each sensor is transmitted to the processing platform. The processing platform correlates the data to determine if a mine explosion has occurred and further determines the location of an event.

The sensors can be incorporated on a single device or can be a distributed set of independent sensors on separate devices that share their information with the data processing platform. The processing platform can also include one or more sensors.

As previously noted, the systems and methods are described herein relative to unmanned mine sweeping operations, wherein the event occurrence to be ascertained is a mine firing or explosion event. However, the systems and methods can be generalized to ascertain the occurrence of events whose transient signatures can be detected by one or more sensors.

Many modifications and variations of the present invention may become apparent in light of the above teachings. For example, the types of platforms used need not be limited to, nor include all of, the platforms shown in FIG. 1. Depending on the type of event to be detected, platforms may be airborne, satellite based, ground based, mobile, surface based, underwater based, or some combination thereof. Additionally, the sensors may be chosen for the specific characteristics of the event or events to be detected.

It will be understood that many additional changes in details, materials, steps, and arrangements of parts which have been described herein and illustrated in order to explain the nature of the invention, may be made by those skilled in the art within the principle and scope of the invention as expressed in the appended claims.

What is claimed is:

1. A method for detecting an event manifesting a plurality of characteristic transient signatures, said method comprising the steps of:

deploying at least one sensor attuned to detect at least one of said characteristic transient signatures;

conducting a sweep of an area of interest;

forcing at least one occurrence of said event by said sweep;

detecting by said at least one sensor at least one of said characteristic transient signatures;

correlating each of said characteristic transient signatures detected to confirm an occurrence of said event; and correlating timing and location information of said detected signatures to determine a timing and location of said occurrence.

2. The method of claim 1, further comprising displaying said occurrence and said timing and location of said occurrence.

3. The method of claim 1, further comprising correlating said detected signatures with historical event data to characterize said event.

4. The method of claim 3, further comprising displaying said occurrence, said timing and location of said occurrence and said characterization of said occurrence.

5. The method of claim 1, further comprising transmitting said detected signatures from said at least one sensor to a processor for correlation.

6. The method of claim 5, further comprising said processor correlating said detected signatures with historical event data to characterize said event.

7. The method of claim 6, further comprising displaying said occurrence, said timing and location of said occurrence and said characterization of said occurrence.

8. The method of claim 7, further comprising displaying an area where further occurrences of said event are mitigated by said sweep.

9. The method of claim 1, wherein:

said step of conducting a sweep comprises deploying an unmanned mine sweeping platform; and said step of forcing at least one occurrence comprises detonating a mine.

10. A method of conducting a mine sweeping operation, comprising:

deploying an unmanned mine sweeping platform, said platform having at least one sensor;

detecting by said at least one sensor a plurality of mine explosion characteristics;

transmitting said plurality of said mine explosion characteristics from said sensor to a processor;

correlating by said processor said plurality of mine explosion characteristics to confirm an occurrence of a mine explosion; and determining by said processor a time and location of said mine explosion based on timing and location information associated with each of said plurality of mine explosion characteristics.

11. A method of conducting a mine sweeping operation, as in claim 10, further comprising correlating by said processor said plurality of mine explosion characteristics with historical mine explosion data to characterize said mine explosion.

12. A method of conducting a mine sweeping operation, as in claim 11, further comprising displaying said occurrence, said timing and location of said mine explosion and said characterization of said mine explosion.

13. A method of conducting a mine sweeping operation, as in claim 12, further comprising displaying an area where a further occurrence of one such mine explosion event is mitigated by said mine sweeping operation.

* * * * *